United States Patent [19]

Francis, Jr.

[11] Patent Number: 4,668,930

[45] Date of Patent: May 26, 1987

[54] TRANSFORMER COIL CONSTRUCTION

[75] Inventor: Ralph M. Francis, Jr., Racine, Wis.

[73] Assignee: Webster Electric Company, Inc., Racine, Wis.

[21] Appl. No.: 789,329

[22] Filed: Oct. 21, 1985

[51] Int. Cl.[4] ..... H01F 27/30

[52] U.S. Cl. ..... 336/180; 336/184; 336/192; 336/198; 336/205

[58] Field of Search ..... 336/96, 205, 198, 208, 336/185, 192, 184, 180

[56] References Cited

U.S. PATENT DOCUMENTS

| | | | |
|---|---|---|---|
| 1,752,866 | 4/1930 | Trombetta | 336/208 |
| 2,339,432 | 1/1944 | Stahl | 336/208 X |
| 2,442,587 | 6/1948 | Coggeshall et al. | 336/208 |
| 2,556,973 | 6/1951 | Nickells | 336/208 X |
| 3,544,937 | 12/1970 | Boysen | 336/96 |
| 3,691,493 | 9/1972 | Boysen et al. | 336/96 X |
| 3,781,741 | 12/1973 | Weiner | 336/198 X |
| 3,947,795 | 3/1976 | Donnelly et al. | 336/184 |
| 4,103,268 | 7/1978 | Anders et al. | 336/208 |
| 4,266,269 | 5/1981 | Toba | 336/185 X |
| 4,454,572 | 6/1984 | Godawski | 336/185 X |

FOREIGN PATENT DOCUMENTS

| | | | |
|---|---|---|---|
| 2236241 | 2/1974 | Fed. Rep. of Germany | 336/192 |
| 460941 | 10/1968 | Switzerland | 336/192 |
| 137632 | 4/1947 | United Kingdom | 336/198 |

*Primary Examiner*—Thomas J. Kozma

*Attorney, Agent, or Firm*—Mason, Kolehmainen, Rathburn & Wyss

[57] ABSTRACT

A high voltage transformer includes at least one secondary coil mounted on an insulating support assembly and having the start lead of the secondary coil disposed proximate to the transformer core with a finish lead disposed at the perimeter of the coil. The finish lead is connected to ground potential and the start lead is provided at the high voltage potential of the transformer, thereby minimizing the insulation requirements of the transformer. The insulating support assembly for the secondary coil includes flanges at the opposite ends thereof to define a winding space for the secondary coil. Each of the flanges includes a channel formed therein for providing a passageway for the high voltage start lead of the secondary coil that extends from the inside layer of the secondary coil to above the edge of the flange. The flange also has a recess that extends between the opposite edges thereof for receiving and insulating sheet member.

5 Claims, 5 Drawing Figures

TRANSFORMER COIL CONSTRUCTION

BACKGROUND OF THE INVENTION

The present invention generally relates to electrical transformers and, more particularly, to high voltage electrical transformers having an improved secondary coil construction.

High voltage transformers often have been constructed with a start or inside lead of the secondary coil connected to the core which is grounded and a finish or outside lead of the secondary coil that provides the high voltage potential. Thus, the highest potential difference between the secondary coil and ground of the conventional transformer occurs at the perimeter of the secondary coil and determines the insulation requirements of the transformer. The insulation requirements of the conventional high voltage transformer have the effect of determining the minimum overall size of the transformer for the high voltage required by the particular use of the transformer. It is highly desirable to provide a high voltage transformer having a smaller size than the conventional high voltage transformers. Additionally, it is highly desirable to provide an improved transformer that has extended life performance by minimizing the breakdown or disruption of the insulation.

SUMMARY OF THE INVENTION

An object of the present invention is to provide a new and improved high voltage transformer.

Another object of the present invention is to provide a new and improved high voltage transformer having a coil construction with reduced insulation requirements, such that the need for insulation between a pair of secondary coils and between the secondary coils and a transformer housing are substantially eliminated.

Another object of the present invention is to provide a new and improved high voltage transformer having a coil construction with reduced insulation requirements, such that the need for voidless potting is eliminated.

Another object of the present invention is to provide a transformer having a secondary coil arranged with a start or inside lead disposed proximate to the core that provides a high voltage potential and a finish lead at the perimeter of the coil that is grounded.

Briefly, the present invention is directed to a new and improved transformer having at least one secondary coil mounted on an insulating support assembly and having the start lead of the secondary coil disposed proximate to the transformer core with a finish lead disposed at the perimeter of the coil. The finish lead is connected to ground potential and the start lead is provided at the high voltage potential of the transformer, thereby minimizing the insulation requirements of the transformer. The insulating support assembly is mounted on the transformer core and is formed with flanges at the opposite ends thereof to define a winding space for the secondary coil. Each of the flanges includes a recess that extends between the opposite peripheral edges thereof for receiving an insulating sheet member. The flange also has a channel formed therein for providing a passageway for the start lead of the secondary coil that extends from the inside layer of the secondary coil to above the edge of the flange.

In accordance with an important feature of the invention, the insulating support assembly is provided between the secondary coil and the transformer core and is physically configured to permit an improved flow of an insulating impregnation material therebetween whereby the transformer insulation characteristics are improved. Another important feature of the present invention is the minimization of the requirement for insulation to be provided between the outside perimeter of the secondary coils and the transformer housing.

BRIEF DESCRIPTION OF THE DRAWING

The above and other objects and advantages and novel features of the present invention will become apparent with the following detailed description of a preferred embodiment of the invention illustrated in the accompanyin drawing, wherein.

DESCRIPTION OF THE PREFERRED EMBODIMENT

Figure 1:
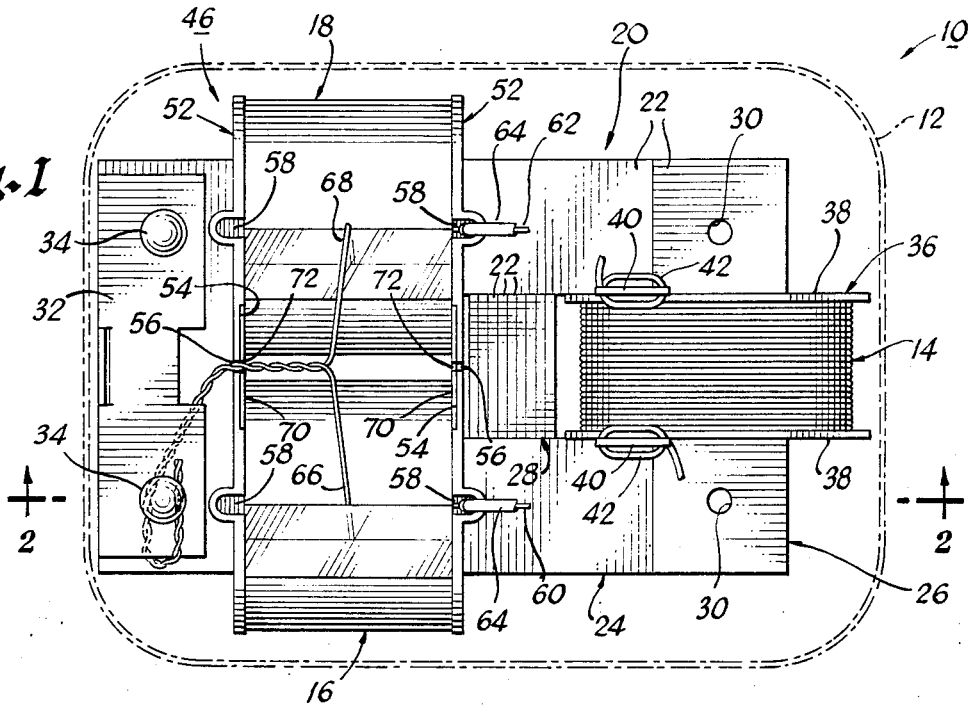
FIG. 1 is a plan view of a transformer constructed in accordance with the principles of the present invention.

Referring now to the drawing, a new and improved high voltage transformer is illustrated, indicated generally by the reference numeral 10 and constructed in accordance with the features of the present invention. The high voltage transformer 10 includes a generally rectangular housing or transformer can 12 shown in broken lines for illustrative purposes and not a requisite part of the invention.

The transformer 10 includes a primary coil 14 and a pair of secondary coils 16, 18 that are mounted on a closed, magnetic transformer core 20. The primary coil and the secondary coils 16, 18 can be wound in a conventional manner in a plurality of layers with an insulating material, for example, Kraft paper, provided between the winding layers. The core 20 is formed of a plurality of relatively thin, stacked laminations 22. The stacked laminations 22 can be provided as a generally U-shaped stack 24 and a generally rectangular stack 26 that are joined, for example by brazing or butt welding, to form the closed magnetic core 20, although various other configurations such as E-I or L-L of the stacked lamination could be used. The magnetic transformer core 20 further includes a generally rectangular lamination, shunt stack 28 that is securely bonded to the opposing legs of the U-shaped lamination stack 24. Each of the lamination stacks 24, 26 include a pair of apertures 30 extending therethrough. A keeper plate 32 is mounted on the end portion of the U-shaped lamination stack 24 by fastening means 34 that are received in the apertures 30.

The primary coil 14 is wound on a bobbin 36 mounted on the rectangular shaped lamination stack 26 of the transformer core 20. Bobbin 36 includes a rectangular sectioned core tube (not shown) carried between two end plates 38 molded from an insulating material, such as plastic. The bobbin 36 conveniently may be formed by a single molding. The end plates 38 are formed to define a winding space for the primary coil 14. The two end plates 38 include an upwardly disposed anchoring tab 40 for retaining the two end leads 42 of the primary coil 14. A spacing tab 44 extends downwardly from each of the end plates 38 to provide the desired spacing between the housing 12 and the primary coil 14. The primary coil 14 is a self-contained assembly that is arranged such that during the assembly of the transformer 10 no additional connections need to be made.

The secondary coils 16, 18 are carried on a dual flange assembly 46 mounted on the opposite legs of the U-shaped lamination stack 24 of the transformer core 20. The dual flange assembly 46 for the secondary coils 16, 18 includes an identical pair of flanges 52. Each flange 52 includes a pair of spaced-apart rectangular axial openings 50 to receive the opposite legs of the U-shaped lamination stack 24. The flanges 52 define a winding space therebetween. Each flange 52 includes a recess 54 disposed between the rectangular axial openings 50 and extending between the opposite peripheral edges thereof. A notch or slot 56 is formed in the edge of the flange 52 and is approximately centrally disposed within the recess 54. A pair of generally U-shaped channels 58 are formed in the flange 52 extending upwardly from the rectangular openings 50 to the edge of the flange 52.

Figure 2:
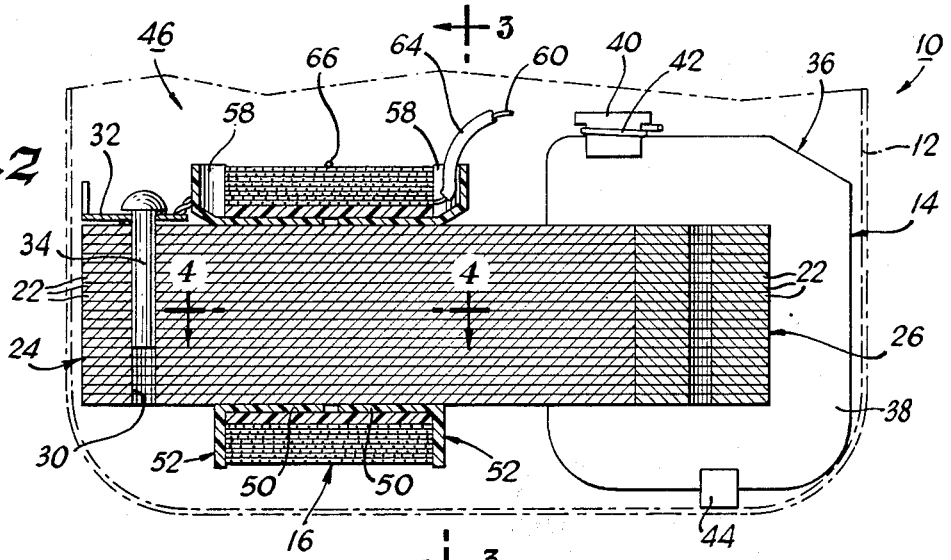
FIG. 2 is a cross sectional view taken along line 2—2 of FIG. 1.
Figure 3:
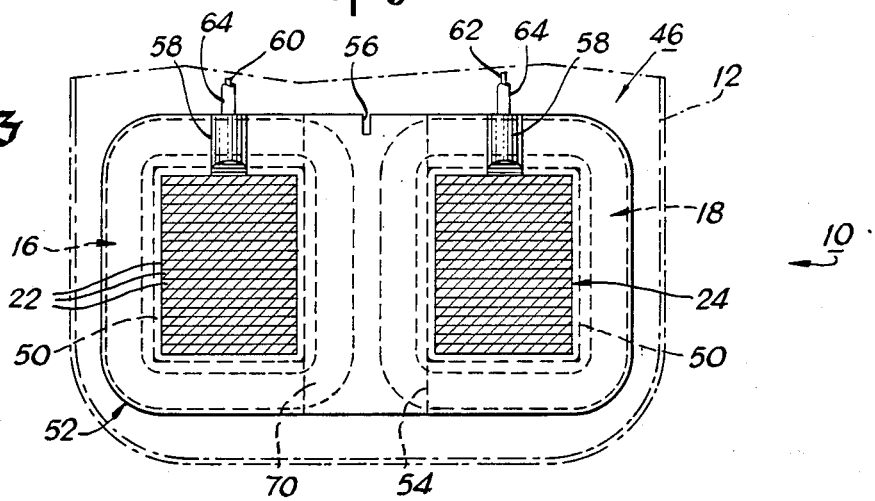
FIG. 3 is a cross sectional view taken along line 3—3 of FIG. 2.
Figures 4, 5:
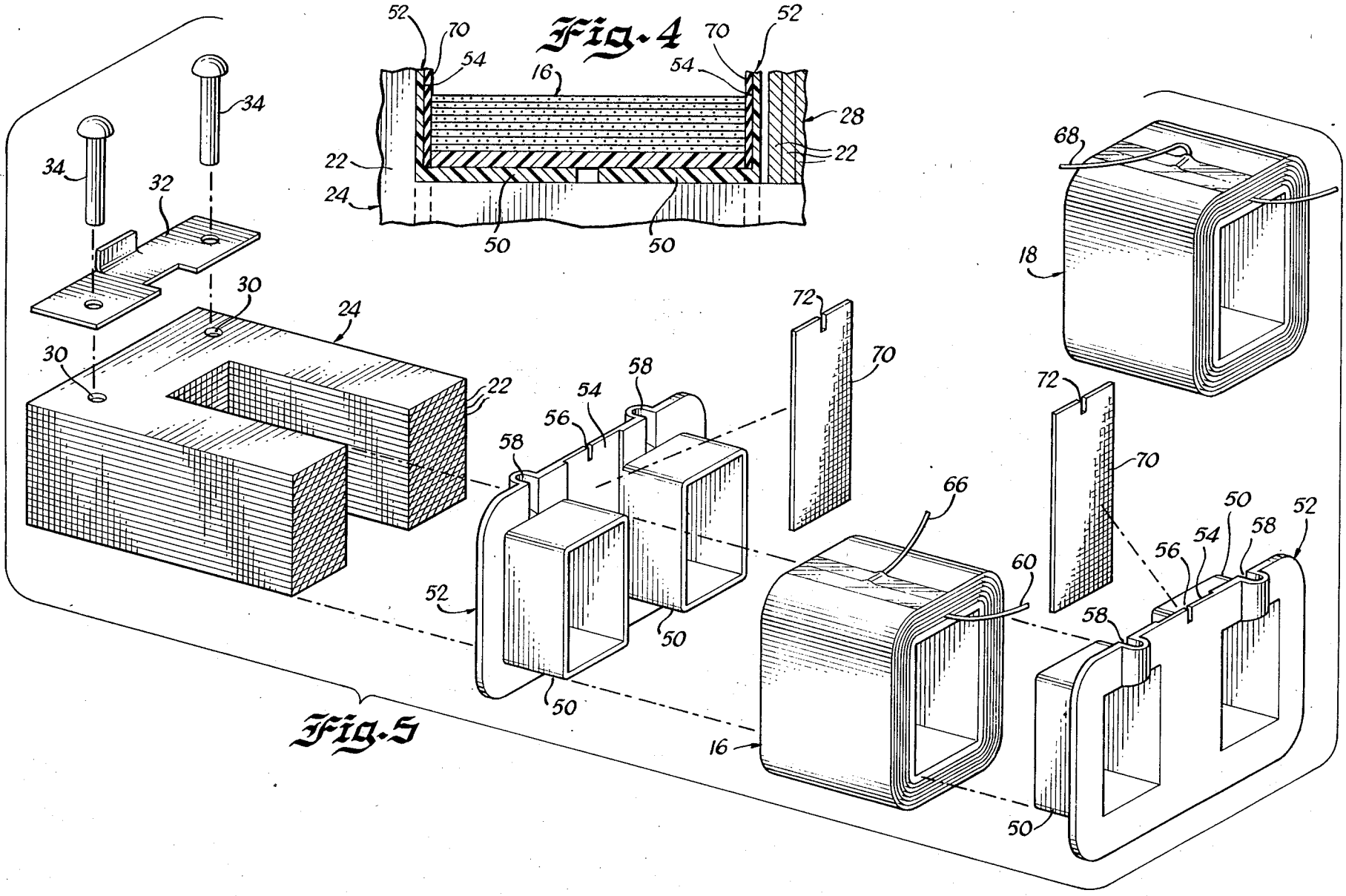
FIG. 4 is an enlarged, cross sectional view taken along the 4—4 of FIG. 2.
FIG. 5 is a partial, exploded perspective view of the transformer of FIG. 1.

The secondary coils 16, 18 include a start lead 60, 62, respectively, disposed at a bottom or inside layer thereof. The U-shaped channels 58 provide a passageway for the start leads 60, 62 to extend from the inside layer of the secondary coils 16, 18 to above the edges of the flanges 52. The start leads 60, 62 are insulated from the remainder of the winding layers of the secondary coils 16, 18 by an insulating tubing member or sleeve 64 (FIG. 2). The start leads 60, 62 of the secondary coils 16, 18 are arranged to provide the high voltage potential of the transformer 10. The secondary coils 16, 18 include a finish lead 66, 68, respectively, disposed at the top or outside layer thereof. The finish leads 66, 68 are connected together, passed through the slot 56 in the flange 52, and terminated by the fastening means 34 to the keeper plate 32. The finish leads 66, 68 are electrically connected and grounded to the core 20 of the transformer 10.

An insulating sheet member 70 having generally the same dimensions as the recess 54 is received within the recess 54 formed in each of the flanges 52 to provide increased electrical insulation between the windings of the secondary coils 16, 18. The insulating sheet member 70 includes a notch or slot 72 that coincides with the slot 56 in the flange 52 to enable passage of the finish leads 66, 68. The transformer core 20 is made dielectrically complete by a conventional vacuum pressure, impregnation process. The insulating sheet 70 that is formed, for example, of fish paper, absorbs the vacuum pressure, impregnation material, such as bywax. The flange assembly 46 for the secondary coils 16, 18 is physically configured to enhance the flow of the impregnation material between the secondary coils 16, 18 whereby gaps or discontinuities in the impregnation compound after curing are minimized.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent of the United States is:

1. A transformer comprising:

a magnetic core connected to ground potential;

at least one primary coil;

a pair of secondary coils, said primary and secondary coils being mounted in inductive relationship with said magnetic core;

each of said secondary coils on an insulating support assembly mounted on said magnetic core, said insulating support assembly each including a pair of spaced-apart flanges for defining a winding space for each of said secondary coils;

each of said secondary coils being wound in a plurality of layers and having a start lead disposed at a bottom layer near said magnetic core and extending between said secondary coil and its flange and a finish lead disposed at a top layer at a perimeter thereof, said finish leads being connected to said magnetic core at ground potential and said start leads providing a high voltage.

2. A transformer as recited in claim 5 wherein said flanges including a channel for providing a passageway for said start lead above said perimeter of said secondary coil.

3. A transformer as recited in claim 5 wherein each of said flanges further includes a recess for receiving an insulating sheet member.

4. A transformer as recited in claim 1, wherein said flanges include a channel for providing passageway for said start leads above said perimeter of said secondary coils.

5. A transformer as recited in claim 1 wherein said insulating support assembly includes a pair of identical flanges.

* * * * *